United States Patent [19]

Yamashita

[11] 4,420,242

[45] Dec. 13, 1983

[54] MAGNETIC BRUSH DEVELOPING AND CLEANING PROCESS

[75] Inventor: Keitaro Yamashita, Saitama, Japan

[73] Assignee: Hitachi Metals, Ltd., Tokyo, Japan

[21] Appl. No.: 355,205

[22] Filed: Mar. 5, 1982

[51] Int. Cl.[3] ..... G03G 15/09

[52] U.S. Cl. ..... 355/3 DD; 118/652; 118/657; 355/15; 355/77; 430/122; 430/125

[58] Field of Search ..... 355/300, 15, 77; 118/652, 657, 658; 430/122, 125

[56] References Cited

U.S. PATENT DOCUMENTS

| | | | |
|---|---|---|---|
| 3,637,306 | 1/1972 | Cooper | 355/15 |
| 3,914,045 | 10/1975 | Namiki et al. | 355/15 |
| 4,003,651 | 1/1977 | Hashida et al. | 355/15 X |
| 4,014,291 | 3/1977 | Davis | 118/657 |
| 4,087,170 | 5/1978 | Sawaoka et al. | 355/3 CH |
| 4,141,648 | 2/1979 | Gaitten et al. | 355/15 X |
| 4,185,910 | 1/1980 | Nomura et al. | 355/15 |
| 4,267,248 | 5/1981 | Yamashita et al. | 118/657 X |

*Primary Examiner*—R. L. Moses

*Attorney, Agent, or Firm*—Finnegan, Henderson, Farabow, Garrett & Dunner

[57] ABSTRACT

A magnetic brush and developing process in which the same magnetic brush is used for developing electrostatic latent images and for cleaning the developing surface. The process includes the steps of (a) providing a magnet roll which includes a rotatable, non-magnetic cylindrical shell and a rotatablepermanent magnet disposed within the shell; (b) forming a magnetic brush of a developer power on the shell of the magnetic roll; (c) developing electrostatic latent images by softly rubbing the magnetic brush against electrostatic latent images on an image bearing surface; (d) transferring the developed images to a sheet; and (e) cleaning the image bearing surface by strongly rubbing the magnetic brush against the surface.

5 Claims, 6 Drawing Figures

MAGNETIC BRUSH DEVELOPING AND CLEANING PROCESS

BACKGROUND OF THE INVENTION 1. Field of the Invention

This invention relates to a copying process wherein electrostatic latent images are formed on surface layer of photosensitive material or dielectric material, developed, transferred and then fixed to form the final images and, in particular to magnetic brush developing and cleaning process wherein the development and cleaning are performed by a single magnetic brush.

2. Description of the Prior Art

It has been known to form electrostatic latent images on the surface layer of photosensitive or dielectric material, to develop such electrostatic latent images by magnetic brush developing process, to transfer the resulting toner images on a transferring sheet of conventional paper or the like, to fix the transferred images by a pressure and/or heating to provide a hard copy, and then to remove the toner remained on the surface of an image holding member and to repeat again the cycle as outlined hereinabove.

Known magnetic brush developing systems for carrying out such a copying process include those disclosed by Anckerson et. al. (U.S. Pat. No. 3,455,276), Nishihama et. al. (U.S. Pat. No. 4,081,571), Asanae et. al. (U.S. Pat. No. 4,231,320), etc.

In such a copying process, one copying cycle is completed ordinarily by one revolution of an image-bearing member which comprises an endless belt or drum. It has been proposed to clean toner remaining on the belt or drum after the transference by means of the magnetic brush employed for the development and such a system has been put into practical use in several copying apparatus. In such a system, electrostatic latent images are formed and developed during one revolution of electrostatic latent image-bearing member and the developed image is transferred, electric change is removed and the remaining toner is cleaned by means of the same magnetic brush during another revolution. Namely, one copying cycle has been completed during two revolutions of the image bearing member. As a cleaning apparatus is not required separately, such a system has advantages in that there can be provided a compact, light weight and inexpensive copying apparatus having a simple structure. However, it is very unreasonable to effect the development and cleaning by a single magnetic brush for the case using one component magnetic toner as compared with the case using two component developer. In addition, known magnetic toners include those disclosed by Nelson et. al. (U.S. Pat. No. 3,639,245), Noguchi et. al. (U.S. Pat. No. 4,189,390), Kawanishi et. al. (U.S. Pat. No. 4,265,993), etc.

Although it has been proposed by Narita (U.S. Pat. No. 3,918,808) to employ jointly a blade during the cleaning process and it has been visualized to employ jointly a fur brush, such means have disadvantages in that the copying apparatus becomes large or that the surface of the image bearing member tends to be damaged. It has been also proposed in Japanese Laid Open Utility Model No. 55-95150 to reduce the contacting width of magnetic toner in contact with the photosensitive material during the developing process by employing an adjusting member. It has been further proposed in Japanese Laid Open Patent No. 55-6303 to alternate the relative condition of magnetic brush to the shell during the developing process and cleaning process by alternating the position of developing magnet poles. The use of such arrangements complicates the mechanism and reduces the reliability of the copying apparatus in each case.

SUMMARY OF THE INVENTION

It is thus a major object of this invention to overcome such drawbacks of conventional art to provide a novel magnetic brush developing and cleaning process.

It is another object of this invention to provide a developing and cleaning process by employing a single magnetic brush which is simple in structure and suitable for the developing process as well as for the cleaning process.

According to this invention, a magnetic brush developing and cleaning process comprises: Providing a magnet roll which contains a rotatable, non-magnetic cylindrical shell and a rotatable permanent magnet disposed within the shell, the rotatable permanent magnet having a plurality of adjacent magnetic poles on the shell; forming a magnetic brush of developer powder on the shell of the magnet roll; developing electrostatic latent images by softly rubbing electrostatic latent images on an image bearing surface with the magnetic brush; transferring the developed images to a sheet; and then cleaning the image bearing surface by strongly rubbing the surface by the magnetic brush.

DESCRIPTION OF THE PREFERRED EMBODIMENT

This invention will be now illustrated in detail by way of these drawings.

Figure 1:
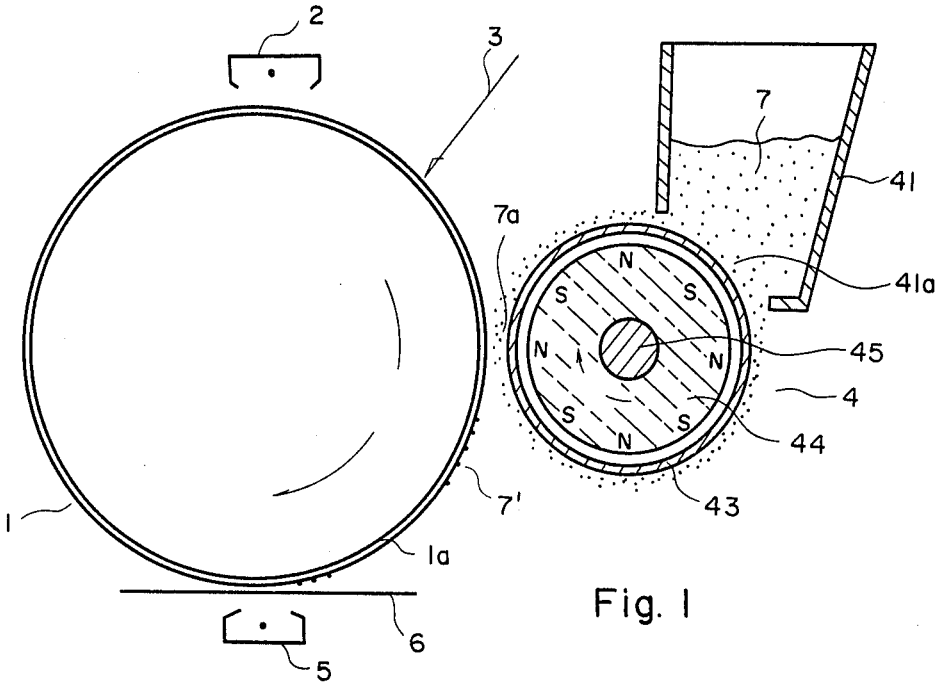
FIG. 1 is a sectional view which illustrates the magnetic brush developing and cleaning process according to this invention.

FIG. 1 is a schematic sectional view of a copying apparatus for providing one copy during two revolutions of an image bearing drum.

In FIG. 1, the surface of a photosensitive drum 1 is formed with a photoconductive layer 1*a*. Drum 1 is turned to the direction as indicated by the arrow in the figure and there are arranged around the drum a corona electrifier 2 for electrifying uniformly the surface of photoconductive layer 1*a*, an optical system 3 for exposing the surface of photo-conductive layer 1*a*, magnetic brush forming equipment 4 and corona transferring equipment 5. In such a system, the surface of photo-conductive layer 1*a* is electrified uniformly by means of corona electrifier 2 and then exposed to light by optical system 3 to form an elecrostatic latent image (not shown). The formed electrostatic latent image is then developed by means of magnetic brush 4 to form toner images 7′ on the surface of photoconductive layer 1*a*. A transferring sheet 6 such as a conventional copying sheet is laminated on the developed toner images 7′ and applied with transferring electric field from the rear surface of transferring sheet 6 by means of corona transferring equipment 5 to transfer toner images 7′ onto transferring sheet 6. The transference is not limited to the use of such transferring electric field, but may be carried out by using an electrified roller. Toner images 7′ are then fixed by pressure and/or heat or the like to provide a hard copy. However, not all of the magnetic toner is transferred onto the transferring sheet during the transference, and about 20% of the toner is normally remained on photoconductive layer 1*a*. According to the present invention, therefore, after revolution of photosensitive drum 1 to complete the transferring step, the drum is confronted again with magnetic brush equipment 4 by the further revolution thereof so that the surface of drum is cleaned. Namely in the copying system as shown in FIG. 1, one hard copy is provided per two revolutions of the photoconductive drum. In addition in normal copying apparatus, electricity removing means such as an AC corona electrifier and/or light source are provided between transferring equipment 6 and corona electrifier equipment 2 for improving the cleaning activity.

The magnetic brush forming apparatus as shown in FIG. 1 is composed of the following members. Magnetic brush forming roller 4 includes non-magnetic shell 43 and permanent magnet roll 44. Non-magnetic cylindrical shell 43 is arranged rotatably proximate photoconductive drum 1. Magnet roll 44 is disposed rotatably within the shell 43 by supporting a cylindrical magnet having a plurality of magnetic poles by means of shaft 45 on the surface thereof. At the outside of shell 43, there is provided a toner vessel 41 in the form of a hopper and provided with a toner supplying opening at the bottom thereof and the toner vessel is fed with a magnetic developer, e.g. magnetic toner 7 therein. By such a structure, magnetic toner 7 is fed from toner supplying opening 41*a* onto the shell 43 and conveyed on the shell by relative rotation between permanent magnet roll 44 and shell 43, thereby forming magnetic brush 7*a*. By rubbing photoconductive layer 1*a* with magnetic brush 7*a*, the developing and cleaning processes are carried out.

Figure 2:
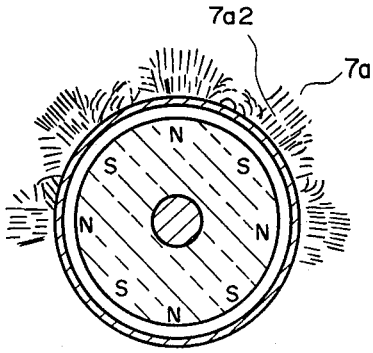
FIG. 2 is a cross-sectional view of the magnetic brush of FIG. 1 at the vicinity of magnet roll.

Magnetic brush 7*a* is formed by the magnetic toner on the surface of shell 43 in magnetic roll 4 and takes a form as shown in FIG. 2. The magnetic toner forms high bristles on the magnetic poles, N, S, N, . . . of magnet 44 and bridges between the bristles at the intervening zones between the poles.

When tips 7*a*-1 of the bristles rub image bearing surface 1*a*, the electrostatic latent images are developed by the magnetic toner of bristles. On the other hand, when central portions 7*a*-2 rub image bearing surface 1*a*, the latent images are not developed but instead the magnetic toner borne on the surface 1*a* 2 is wiped off.

In other words, when rubbed softly by magnetic brush 7*a*, the latent images are developed, but when rubbed strongly, the borne magnetic toner is removed so as to clean the image bearing surface.

Figure 3:
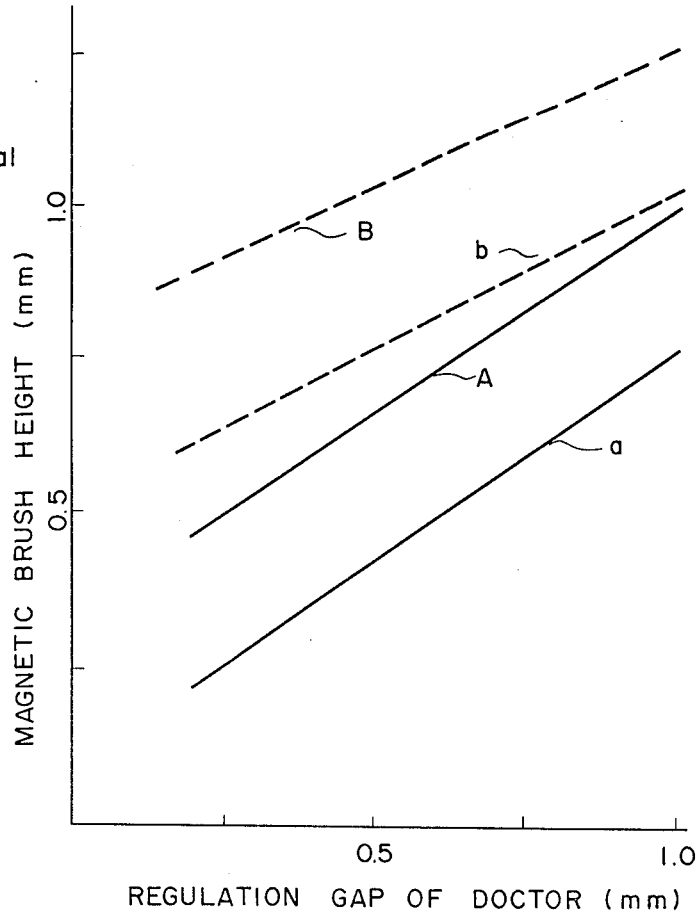
FIG. 3 is a graph which illustrates the relation between the magnetic brush height and regulation gap of doctor.

FIG. 3 illustrate the result of observation on the height of magnetic brush 7*a* on magnet roll 4 when the doctor gap proximate the lower portion of opening 41*a* for controlling the height of toner at the outlet of toner vessel 41 is varied.

When permanent magnet 44 is turned clockwise to the x-direction in FIG. 1 as shell 43 is stationary, the height of magnetic brush 7*a* depicts Curves A and a as shown in FIG. 3. Curve A shows the height up to the tip of the bristles and curve a shows the height between the poles. When permanent magnet 44 is turned clockwise, magnetic toner on shell 43 is conveyed counterclockwise on magnet roll 4 while rotating on the shell by the approaching magnetic poles from the left side.

On the other hand, if permanent magnet 44 of magnet roll 4 is turned clockwise in the x-direction and non-magnetic shell 43 is turned counterclockwise, then magnetic toner 7 will be conveyed on the shell counterclockwise. The height of magnetic brush 7*a* comprising the magnetic toner depicts Curves B and b as shown in FIG. 3, wherein B is the height up to the tip of bristles and curve b shows the height of bristles between the poles.

As shown in FIG. 3, when magnet 44 and shell 43 are turned concurrently at a constant regulation gap of doctor, the height of magnetic brush 7*a* is twice as high as that when only magnet 44 is turned.

Figure 4:
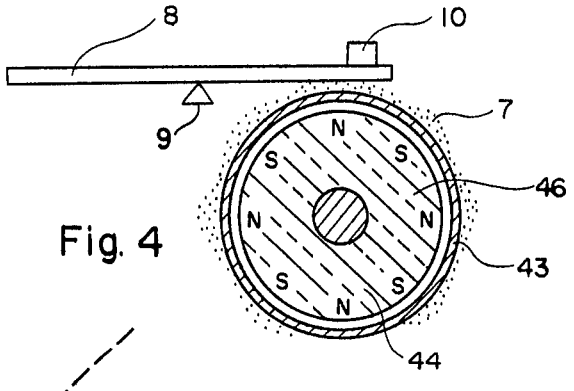
FIG. 4 is a sectional view which illustrates a mechanism for measuring the conveying ability of magnetic brush due to the magnet roll.

The conveying ability of toner was compared for various toner conveying systems by means of an apparatus as shown in FIG. 4. In this apparatus, magnetic toner 7 is disposed on a magnetic brush forming roll 44 incorporating a shell having an outer diameter of 31.4 mm and a permanent magnet roll 46 having an outer diameter of 29.3 mm, 8 poles magnetized symmetrically and magnetic flux of 850 G on the shell. Cover glass 8 is installed above the toner layer by supporting fulcrum 9. A weight 10 is mounted on one end of cover glass 8 and is measured when the flow of toner is stopped to be defined as the conveying ability.

As a result, it was found that the conveying ability of toner in the case of rotating the shell was approximately 10 times as great as that for the case of rotating the magnet alone, and that the conveying ability of toner is independent on the r.p.m. of magnet or shell, i.e. the conveying speed of toner.

Figure 5:
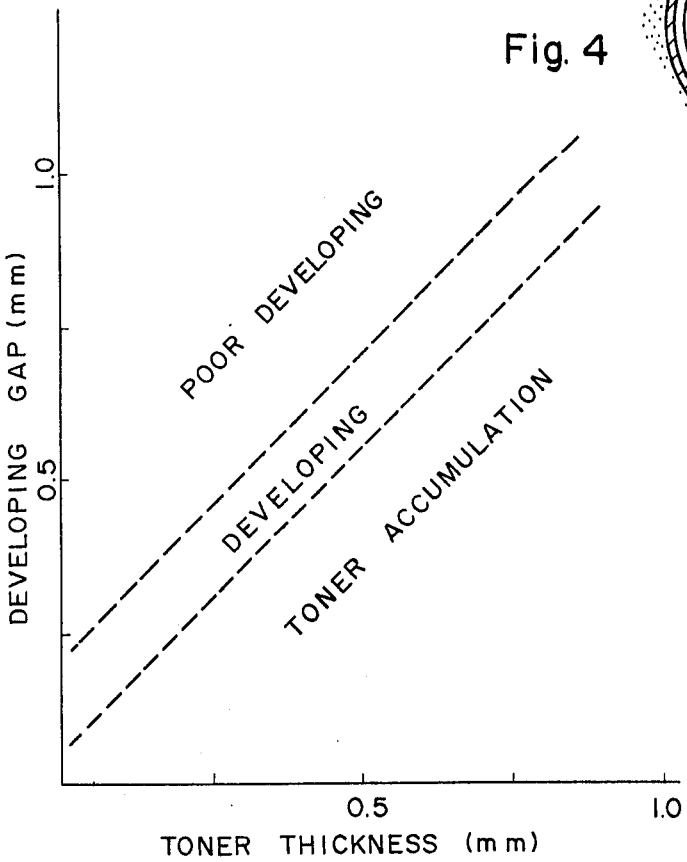
FIG. 5 is a graph which illustrates the relation between the toner thickness and developing thickness.

FIG. 5 illustrates the developing conditions when the developing gap is varied with respect to the height of brush 7*a* of magnetic toner on shell 43. If the developing gap is smaller than the thickness of toner, since the amount of toner supplied to the developing zone is higher than that of toner passing through the developing zone, the toner will be accumulated upstream of the developing zone. If the developing gap is slightly larger than the toner thickness, the image bearing surface will be softly rubbed only by the tips of toner bristles to develop the electrostatic latent images on the shell. The optimum development is carried out when developing gap is larger by 0.05 to 0.20 mm than the toner thickness. When permanent magnet 44 is turned concurrently with shell 43, larger conveying ability is induced as disclosed hereinbefore, so that the image bearing surface is rubbed with large bristles to scrape away the toner on the image bearing surface.

An excessively narrow developing gap D tends to accumulate the toner so that it is necessary to widen the developing gap to some extent. However, when the D is excessively wide, the toner fails to sufficiently contact the drum so that a sufficient concentration of copied images cannot be produced.

With increased rotation of the permanent magnet roll, the speed of toner is accelerated to extend the width of magnetic brush. While the excessively small magnetic brush cannot achieve the sufficient contact, the excessively large magnetic brush strengthens the cleaning effect. Accordingly, the rotation of the permanent magnetic roll is preferably designed to be in a range of 5 to 20 times the peripheral speed of the photoconductive drum.

During the developing step, relatively good development can be performed not only by rotating the magnet as referred to hereinabove, but also by rotating the shell in the same direction of rotating magnet at a relatively low speed. In such a case, the conveying ability of toner is naturally larger than the case rotating the magnet but substantially smaller than the case rotating the shell. In addition, the toner conveying speed is the difference between the rotating speed of magnet and the revolving speed of shell so that the speed is relatively retarded. Hence in the concurrent rotating system of magnet and shell, the toner conveying ability is enhanced but the toner conveying speed is retarded so that while the relatively larger magnetic brush is formed, it is contacted softly with the drum so that the developing efficiency is improved. The peripheral speed of shell ranges preferably from 0.1 to 0.2 times of that of permanent magnet roll.

In the cleaning step, the large magnetic brush is formed and the surface of drum is rubbed strongly by the formed magnetic brush, so that it is proposed to rotate the shell to the opposite direction to that of permanent magnet roll at a relatively higher speed during the cleaning step. By such a toner conveying system, the toner on the shell is affected by the concurrent actions of rotating force based on the alternating magnetic field due to the rotation of permanent magnet roll and friction force due to the rotation of shell, so that because of very enhanced toner conveying ability, the thickness of toner layer becomes higher than that in the case of magnet rotating system to form the larger magnetic brush. In addition, since the toner on the shell is conveyed at a synthesized speed comprising the rotating speed of the magnet and the revolving speed of shell, the formed magnetic brush contacts strongly with the drum. Hence according to the toner conveying system as disclosed above, the toner remaining on the drum is shifted from the position of drum to reduce the adhesion therewith and recovered easily into the magnetic brush to effect the sufficient cleaning. However, as the excessively strong toner conveying ability strengthens the rubbing force of the photoconductive layer with the magnetic brush to be susceptible to damage the photoconductive material and to cause filming phenomenon and also to block the toner. Hence the peripheral speed of the shell is preferably designed to be approximately 1/7 to 1/10 of the rotating speed of permanent magnet roll.

Figure 6:
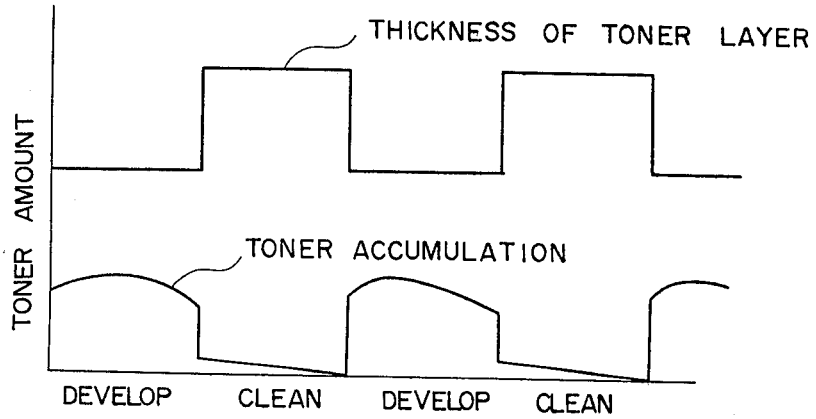
FIG. 6 is a graph showing the amounts of toner during the developing and cleaning steps.

FIG. 6 illustrates time charts of the thicknesses of toner layer and toner pool during the developing and cleaning steps.

As shown in FIG. 6, the thickness of toner layer conveyed on the shell is reduced during the developing step, whereas the thickness is increased during the cleaning step. The amount of toner in the pool upstream of the developing gap shows a peak during the developing step but disappears substantially during the cleaning step.

As set forth above, the permanent magnet roll is rotated at a constant speed in this invention, but the size of the magnetic brush and contacting condition with the drum are controlled depending on the developing step and cleaning step by adjusting variably the r.p.m. and the rotating direction of shell. In such a case, as the shell has a small weight so that the moment of inertia is small and the r.p.m. is not required to be controlled at an excessively high speed, the control can be effected easily and the actual workability is sufficient.

EXAMPLE

In FIG. 1, a Se drum having a diameter of 120 mm was employed as the photoconductive drum and rotated at a speed of 150 mm/sec. The permanent magnet roll had an outer diameter of 29.3 mm and 10 magnetized symmetrical poles having a magnetic flux of 700 G on the shell and was rotated at 1200 r.p.m. As the shell, a stainless steel cylinder having a diameter of 32 mm was employed. The used magnetic toner has specific resistivity of $10^{14}$ Ω.cm and particle size ranging from 10 to 20 μm. During the developing step, the shell was rotated at 30 r.p.m. and during the cleaning step, it was rotated at 150 r.p.m. to provide subsequently up to 55 distinct copies capable of being put into practical use.

When the cleaning step was carried out under the same conditions as above, copies bearing double thin images were obtained.

The surface electicity on the drum was removed by applying an AC voltage of 5.5 kV by means of an AC corona electrifier means and then the cleaning was carried out in the above example.

What is claimed is:

1. A magnetic brush developing and cleaning process, comprising the steps of:

providing a magnet roll which includes a rotatable, non-magnetic cylindrical shell and a rotatable permanent magnet disposed within said shell, said rotatable permanent magnet having a plurality of adjacent magnetic poles in proximity to said shell;

forming a magnetic brush of a developer powder on said shell of said magnet roll;

developing electrostatic latent images by rotating at least said permanent magnet and softly rubbing said magnetic brush against electrostatic latent images on an image bearing surface;

transferring the developed images to a sheet; and cleaning said image bearing surface by rotating said sleeve and said permanent magnet in opposite directions, and strongly rubbing said magnetic brush against said surface.

2. The magnetic brush developing and cleaning process as set forth in claim 1, wherein during the developing step, tip portions of said magnetic brush rub the image bearing surface.

3. The magnetic brush developing and cleaning process as set forth in claim 2 or 1, having a developing gap in a range of d+0.05 (mm) to d+0.20 (mm), the developing gap being defined as the distance the image bearing surface is separated from the surface of the magnet roll and d being the height of the magnetic brush of developer powder above the surface of said shell.

4. The magnetic brush developing and cleaning process as set forth in claim 2 or 1, wherein during the developing step, the shell is also rotated, the surface speed of the shell being less than 0.2 times the surface speed of the permanent magnet.

5. The magnetic brush developing and cleaning process as set forth in claim 4, wherein the surface speed of the permanent magnet is 5 to 20 times the surface speed of the image bearing surface.

* * * * *